US005798617A

United States Patent [19]

Moisin

[11] Patent Number: 5,798,617

[45] Date of Patent: Aug. 25, 1998

[54] MAGNETIC FEEDBACK BALLAST CIRCUIT FOR FLUORESCENT LAMP

[75] Inventor: Mihail S. Moisin, Brookline, Mass.

[73] Assignee: Pacific Scientific Company, Newport Beach, Calif.

[21] Appl. No.: 768,508

[22] Filed: Dec. 18, 1996

[51] Int. Cl.[6] ..... H05B 41/16

[52] U.S. Cl. ..... 315/247; 315/224; 315/244; 315/307; 315/209 R; 315/DIG. 4

[58] Field of Search ..... 315/247, 224, 315/244, 307, 209 R, 291, 200 R, 218, 282, 344, DIG. 4, DIG. 7

[56] References Cited

U.S. PATENT DOCUMENTS

| | | | |
|---|---|---|---|
| 2,505,112 | 7/1950 | Hallman | 173/323 |
| 2,966,602 | 12/1960 | Waymouth et al. | 313/44 |
| 3,112,890 | 12/1963 | Snelling | 240/51.11 |
| 3,517,259 | 6/1970 | Dotto | 315/200 |
| 3,569,817 | 3/1971 | Boehringer | 321/2 |
| 3,611,021 | 10/1971 | Wallace | 315/239 |
| 3,736,496 | 5/1973 | Lachocki | 323/22 T |
| 3,882,356 | 5/1975 | Stehlin | 315/205 |
| 3,913,000 | 10/1975 | Cardwell, Jr. | 321/2 |
| 3,965,345 | 6/1976 | Fordsmand | 240/47 |
| 3,974,418 | 8/1976 | Fridrich | 315/59 |
| 4,005,334 | 1/1977 | Andrews | 315/208 |
| 4,016,451 | 4/1977 | Engel | 315/158 |
| 4,053,813 | 10/1977 | Kornrumpf et al. | 315/206 |
| 4,125,767 | 11/1978 | Silver | 250/214 D |
| 4,127,795 | 11/1978 | Knoll | 315/210 |
| 4,127,798 | 11/1978 | Anderson | 315/209 R |
| 4,135,116 | 1/1979 | Smith | 315/158 |
| 4,160,288 | 7/1979 | Stuart et al. | 363/41 |

(List continued on next page.)

FOREIGN PATENT DOCUMENTS

| | | |
|---|---|---|
| 0114370 | 8/1984 | European Pat. Off. . |
| 0127101 | 12/1984 | European Pat. Off. . |
| 0239863 | 10/1987 | European Pat. Off. . |
| 0395776 | 11/1990 | European Pat. Off. . |
| 0441253 | 8/1991 | European Pat. Off. . |
| 3437554 | 4/1986 | Germany . |
| 0259646 | 3/1988 | Germany . |
| 3632272 | 4/1988 | Germany . |
| 3813672 | 11/1988 | Germany . |
| 655042 | 12/1976 | Russian Federation . |
| 9000830 | 1/1990 | WIPO . |
| 9009729 | 8/1990 | WIPO . |
| 9309649 | 5/1993 | WIPO . |
| 94/27420 | 11/1994 | WIPO . |

OTHER PUBLICATIONS

Kröning, et al., "New Electronic Control Gear," *Siemens Power Engineering & Automation VII*, No. 2, pp. 102–104 1985.

Hayt, et al., *Engineering Circuit Analysis*, 3d ed., pp. 296–297, 1978.

OSRAM DELUX® compact fluorescent lamps, "Economical long-life lighting—with extra convenience of electronic control gear", pp. 1–15.

Philips Lighting, "Lamp specification and application guide", pp. 1, 11, 61–64, 78.

*Primary Examiner*—Benny T. Lee
*Assistant Examiner*—Haissa Philogene
*Attorney, Agent, or Firm*—Knobbe, Martens, Olson & Bear, LLP

[57] ABSTRACT

An improved ballast circuit for use with a fluorescent lamp includes an EMI filter, a feedback network, a rectifier and voltage amplification stage, and an active resonant circuit which connects to the lamp load. The ballast circuit includes a magnetic feedback path which couples the resonant circuit to the feedback network. The magnetically coupled feedback network of the improved ballast circuit reduces the non-linear characteristics of the rectifier diodes, thus providing an almost linear load to the input power supply and therefore achieving an improved power factor, on the order of 0.95 or greater. The improved ballast circuit may also include a dimming stage which works with the active resonant circuit to vary the amount of power that is supplied to the lamp load. The dimming stage does not require the addition of parasitic active stages and thus provides a lamp with high electrical efficiency.

27 Claims, 4 Drawing Sheets

U.S. PATENT DOCUMENTS

| | | | |
|---|---|---|---|
| 4,168,453 | 9/1979 | Gerhard et al. | 315/225 |
| 4,230,971 | 10/1980 | Gerhard et al. | 315/307 |
| 4,237,403 | 12/1980 | Davis | 315/98 |
| 4,245,285 | 1/1981 | Weiss | 363/17 |
| 4,284,925 | 8/1981 | Bessone et al. | 315/240 |
| 4,348,615 | 9/1982 | Garrison et al. | 315/219 |
| 4,350,891 | 9/1982 | Wuerflein | 378/110 |
| 4,353,009 | 10/1982 | Knoll | 315/220 |
| 4,370,600 | 1/1983 | Zansky | 315/244 |
| 4,379,254 | 4/1983 | Hurban | 315/291 |
| 4,388,563 | 6/1983 | Hyltin | 315/205 |
| 4,392,087 | 7/1983 | Zansky | 315/219 |
| 4,393,323 | 7/1983 | Hubner | 313/110 |
| 4,395,660 | 7/1983 | Waszkiewicz | 315/291 |
| 4,399,391 | 8/1983 | Hammer et al. | 315/244 |
| 4,423,348 | 12/1983 | Greiler | 313/113 |
| 4,443,740 | 4/1984 | Goralnik | 315/284 |
| 4,481,460 | 11/1984 | Kröning et al. | 323/266 |
| 4,510,400 | 4/1985 | Kiteley | 307/66 |
| 4,523,131 | 6/1985 | Zansky | 315/307 |
| 4,533,986 | 8/1985 | Jones | 363/17 |
| 4,544,863 | 10/1985 | Hashimoto | 315/209 R |
| 4,547,706 | 10/1985 | Krummel | 315/226 |
| 4,562,383 | 12/1985 | Kerscher et al. | 315/225 |
| 4,580,080 | 4/1986 | Smith | 315/199 |
| 4,612,479 | 9/1986 | Zansky | 315/194 |
| 4,613,934 | 9/1986 | Pacholok | 363/131 |
| 4,616,158 | 10/1986 | Krummel et al. | 315/225 |
| 4,620,271 | 10/1986 | Musil | 363/21 |
| 4,626,746 | 12/1986 | Zaderej | 315/208 |
| 4,631,450 | 12/1986 | Lagree et al. | 315/244 |
| 4,641,061 | 2/1987 | Munson | 315/210 |
| 4,647,817 | 3/1987 | Fähnrich et al. | 315/104 |
| 4,651,060 | 3/1987 | Clark | 315/199 |
| 4,677,345 | 6/1987 | Nilssen | 315/209 R |
| 4,682,083 | 7/1987 | Alley | 315/307 |
| 4,683,402 | 7/1987 | Aubrey | 315/56 |
| 4,700,113 | 10/1987 | Stupp et al. | 315/224 |
| 4,730,147 | 3/1988 | Kroening | 315/100 |
| 4,739,227 | 4/1988 | Anderson | 315/260 |
| 4,742,535 | 5/1988 | Hino et al. | 378/105 |
| 4,743,835 | 5/1988 | Bossé et al. | 323/266 |
| 4,857,806 | 8/1989 | Nilssen | 315/72 |
| 4,859,914 | 8/1989 | Summa | 315/354 |
| 4,864,482 | 9/1989 | Quazi et al. | 363/37 |
| 4,894,587 | 1/1990 | Jungreis et al. | 315/200 R |
| 4,933,605 | 6/1990 | Quazi et al. | 315/224 |
| 4,943,886 | 7/1990 | Quazi | 361/42 |
| 4,949,020 | 8/1990 | Warren et al. | 315/297 |
| 4,950,963 | 8/1990 | Sievers | 315/360 |
| 4,954,768 | 9/1990 | Luchaco et al. | 323/300 |
| 4,988,921 | 1/1991 | Ratner et al. | 315/159 |
| 4,996,462 | 2/1991 | Krummel | 315/209 R |
| 4,999,547 | 3/1991 | Ottenstein | 315/307 |
| 5,001,386 | 3/1991 | Sullivan et al. | 315/219 |
| 5,003,230 | 3/1991 | Wong et al. | 315/279 |
| 5,004,959 | 4/1991 | Nilssen | 315/291 |
| 5,004,972 | 4/1991 | Roth | 323/320 |
| 5,039,914 | 8/1991 | Szuba | 315/158 |
| 5,041,763 | 8/1991 | Sullivan et al. | 315/176 |
| 5,083,081 | 1/1992 | Barrault et al. | 324/126 |
| 5,084,653 | 1/1992 | Nilssen | 315/219 |
| 5,089,751 | 2/1992 | Wong et al. | 315/279 |
| 5,097,181 | 3/1992 | Kakitani | 315/209 R |
| 5,101,142 | 3/1992 | Chatfield | 315/308 |
| 5,172,033 | 12/1992 | Smits | 315/224 |
| 5,172,034 | 12/1992 | Brinkerhoff | 315/307 |
| 5,173,643 | 12/1992 | Sullivan et al. | 315/276 |
| 5,174,646 | 12/1992 | Siminovitch et al. | 362/218 |
| 5,175,477 | 12/1992 | Grissom | 315/291 |
| 5,185,560 | 2/1993 | Nilssen | 315/219 |
| 5,192,896 | 3/1993 | Qin | 315/224 |
| 5,194,782 | 3/1993 | Richardson et al. | 315/291 |
| 5,198,726 | 3/1993 | Van Meurs et al. | 315/224 |
| 5,214,356 | 5/1993 | Nilssen | 315/224 |
| 5,233,270 | 8/1993 | Nilssen | 315/58 |
| 5,237,243 | 8/1993 | Chung | 315/219 |
| 5,245,253 | 9/1993 | Quazi | 315/224 |
| 5,289,079 | 2/1994 | Wittman | 313/318 |
| 5,289,083 | 2/1994 | Quazi | 315/224 |
| 5,296,783 | 3/1994 | Fischer | 315/64 |
| 5,309,062 | 5/1994 | Perkins et al. | 315/53 |
| 5,313,142 | 5/1994 | Wong | 315/205 |
| 5,321,337 | 6/1994 | Hsu | 315/219 |
| 5,331,253 | 7/1994 | Counts | 315/209 R |
| 5,341,067 | 8/1994 | Nilssen | 315/209 R |
| 5,363,020 | 11/1994 | Chen et al. | 315/209 R |
| 5,394,064 | 2/1995 | Ranganath et al. | 315/209 R |
| 5,396,154 | 3/1995 | Shiy et al. | 315/291 |
| 5,396,155 | 3/1995 | Bezdon et al. | 315/291 |
| 5,404,082 | 4/1995 | Hernandez et al. | 315/219 |
| 5,519,289 | 5/1996 | Katyl et al. | 315/224 |
| 5,559,394 | 9/1996 | Wood | 315/224 |
| 5,596,247 | 1/1997 | Martich et al. | 315/56 |

MAGNETIC FEEDBACK BALLAST CIRCUIT FOR FLUORESCENT LAMP

BACKGROUND OF THE INVENTION

1. Field of the Invention

The present invention relates to electric circuits for operating fluorescent lamps, and, more particularly to ballast circuits for compact fluorescent lamps.

2. Description of the Prior Art

A fluorescent lamp is a conventional lighting device which is a gas charged device that provides illumination as a result of atomic excitation of low-pressure gas, such as mercury, within a lamp envelope. The excitation of the mercury vapor atoms is provided by a pair of arc electrodes mounted within the lamp. In order to properly excite the mercury vapor atoms, the lamp is ignited and operated at a relatively high voltage and at a relatively constant current. The excited atoms emit invisible ultraviolet radiation. The invisible ultraviolet radiation in turn excites a fluorescent material, e.g., phosphor, that is deposited on an inside surface of the fluorescent lamp envelope, thus converting the invisible ultraviolet radiation to visible light. The fluorescent coating material is selected to emit visible radiation over a wide spectrum of colors and intensities.

As is known to those of skill in the art, a ballast circuit is commonly disposed in electrical communication with the lamp to provide the elevated voltage levels and the constant current required for fluorescent illumination. Typical ballast circuits electrically connect the fluorescent lamp to line alternating current and convert this alternating current provided by the power transmission lines to the constant current and voltage levels required by the lamp.

Fluorescent lamps have substantial advantages over conventional incandescent lamps. In particular, the fluorescent lamps are substantially more efficient and typically use 80 to 90% less electrical power than incandescent lamps of equivalent light output.

For these reasons, fluorescent lamps have been widely used in a number of applications, especially in commercial buildings where the unusual shape and size (in contrast to incandescent bulbs) is either not a disadvantage or is actually an advantage.

In view of the significant advantages of the fluorescent tubes, it would seem to be a natural to largely replace use of the incandescent lamp in the home environment, especially now that compact fluorescent tubes are available.

However, to date, these lamps have several serious disadvantages which have limited their use. These disadvantages include:

1. The ballast circuit, unlike an incandescent bulb, presents a non-linear load to the A.C. line. Typically the power factor which measures the phase relationship of the current and voltage of a conventional ballast circuit is about 0.4, which is an undesirable level. One prior solution to the ballast circuit problem is to employ an electronic ballast circuit which electrically is more efficient. However, these ballast circuits require a large number of electrical components which increases the cost of the fluorescent lamp. Further, the addition of these electrical components causes harmonic distortion problems and provides a lower than desired power factor.

2. Fluorescent lamps have been relatively large, both because of the lamp itself but also because of the space required to house the ballast circuit. As a result, contemporary fluorescent lamps cannot readily replace many incandescent lamps used in the home and elsewhere.

3. Dimmable fluorescent lamps suffer from a number of compromises. Common problems are flickering and striations, e.g., alternating bands of illumination and non-illumination across the fluorescent lamps, in the dimmed conditions, uneven non-gradual dimming, a small range of dimming, and high cost of the dimming circuit.

4. Conventional ballasts emit unacceptable levels of electromagnetic interference (EMI) and radio-frequency interference (RFI). The high levels of interference often make the fluorescent lamp unacceptable near radios, televisions, personal computers and the like.

5. Although the fluorescent tube itself has a very long life, the ballast, particularly ballasts capable of dimming the fluorescent tube, have suffered from excessive failures in the field. In addition, many dimmable fluorescent lamp ballasts suffer catastrophic failure if the ballast is plugged into line voltage without a fluorescent tube in the circuit.

6. Some prior art ballast circuits require a large ferrite core inductor to be placed between the lamp and the input power circuit to provide a selected degree of electrical isolation between the power transmission lines at the input and the lamp, while allowing the conduction of the necessary current levels to the fluorescent lamp. Despite the fact that these ballast circuits provide the desired current and voltage levels, they do so at the price of the electrical efficiency of the ballast circuit.

SUMMARY OF THE INVENTION

The present invention comprises a ballast circuit for a compact fluorescent lamp that has a high electrical efficiency and a high power factor rating. The improved ballast circuit of the present invention preferably comprises an EMI filter, a feedback network, a rectifier and voltage amplification stage, and an active resonant circuit stage which drives the lamp and is magnetically coupled to the feedback network. The ballast circuit additionally comprises a dimming circuit to enable a full range of variable adjustment of the level of brightness of the fluorescent lamp, from very dim to 100% light output.

A significant feature of the present invention is that the adverse effects and problems found in the prior art are either eliminated or reduced to such low levels as to make the present invention essentially "plug-to-plug" compatible with an incandescent lamp but with all of the attendant advantages of the fluorescent tubes. As indicated above, the power factor typically associated with compact fluorescent lamps of the prior art is in the range of about 0.4–0.6 which is an undesirable level. In the present invention, the power factor correction is much higher, e.g., on the order of 0.95 or greater. In the preferred embodiment this is achieved by a magnetic feedback path which couples the high frequency load current from the lamp back to a feedback network connected to the input of the rectifier and voltage amplification stage. This feedback path has been found to substantially compensate for the non-linear characteristics of the rectifier diodes in a power converter. By eliminating the non-linearities of the diodes, the ballast circuit appears as an almost linear load at the input voltage interface, thus achieving the very high level of power factor correction.

In accordance with one aspect of the present invention, the ballast circuit provides a dramatically improved dimming capability. This is achieved by including an improved dimmer control circuit to enable variable adjustment of the level of brightness of the fluorescent lamp. The dimmer control circuit preferably controls the operation of a switching transistor in the active resonant circuit to suppress the operation of the transistor during a portion of the conductive cycle of the transistor. This causes the active resonant circuit to produce an asymmetric waveform, thus providing a lower average power to the fluorescent lamp to dim its output.

A further significant feature of the dimmable ballast circuit described herein is that it requires only a single active stage to perform all the necessary functions of a ballast circuit, including lamp start-up, lamp driving operations, and local dimming of the lamp. The streamlined circuit design also provides for high electrical efficiency of the operating circuit because of the lack of additional parasitic active stages. Further, as indicated above, the resonant circuit provides for low total harmonic distortion and for high power factor correction, achieving a power factor of greater than 0.95.

Accordingly, the present invention provides a ballast for a dimmable, screw-in compact fluorescent lamp. The ballast comprises the series connection of an EMI filter stage, a feedback network, a rectification and voltage doubler stage and an active resonant circuit which drives the lamp. The ballast also comprises a magnetic feedback path which provides feedback from the active resonant circuit back to the feedback network. The ballast further comprises a dimmer circuit which is connected to the active resonant circuit.

Under another aspect, the present invention is a ballast for a fluorescent lamp providing a very high power factor input of 0.95 or greater to the power line. The ballast comprises the series connection of a rectification and voltage doubler stage and a high frequency resonant circuit to drive the lamp. The AC power input is connected to the input of the rectification and voltage doubler stage. The ballast also comprises a feedback network electrically connected in shunt across the input power line and magnetically coupled to the high frequency resonant circuit. In a preferred embodiment, the feedback network comprises the series connection of an inductor and a capacitor.

Under another aspect, the present invention is a simple ballast which operates a compact fluorescent lamp at 100% brightness. The ballast comprises the series connection of an EMI filter, a feedback network, a rectification and voltage doubler stage, and an active high frequency resonant circuit stage which drives the lamp. The ballast also comprises a magnetic feedback path which connects the high frequency resonant circuit directly to feedback the network.

Under another aspect, the present invention is a ballast for driving at least one fluorescent lamp. The first stage of the ballast comprises a rectification and voltage doubler stage which is driven by the AC power input. The output of the rectification and voltage doubler stage is connected to the input of a feedback network. The output of the feedback network is connected to the input of an active high frequency resonant circuit stage. The active high frequency resonant circuit stage comprises a pair of switching transistors and a transformer with a single primary winding and three secondary windings. The first secondary winding drives the first switching transistor. The second secondary winding drives the second switching transistor with a phase opposite that of the first switching transistor. The third secondary winding is connected to an inductor in the feedback network in order to provide power factor correction. In an alternative embodiment, the ballast also comprises a dimmer circuit which is connected to the active high frequency circuit. The dimmer circuit dims the lamp by suppressing the operation of one of the switching transistors.

BRIEF DESCRIPTION OF THE DRAWINGS

The foregoing and other objects, features, and advantages of the invention will be apparent from the following description and from the accompanying drawings, in which like reference numerals refer to the same parts throughout the different views, and wherein.

DETAILED DESCRIPTION OF THE INVENTION

Figure 1:
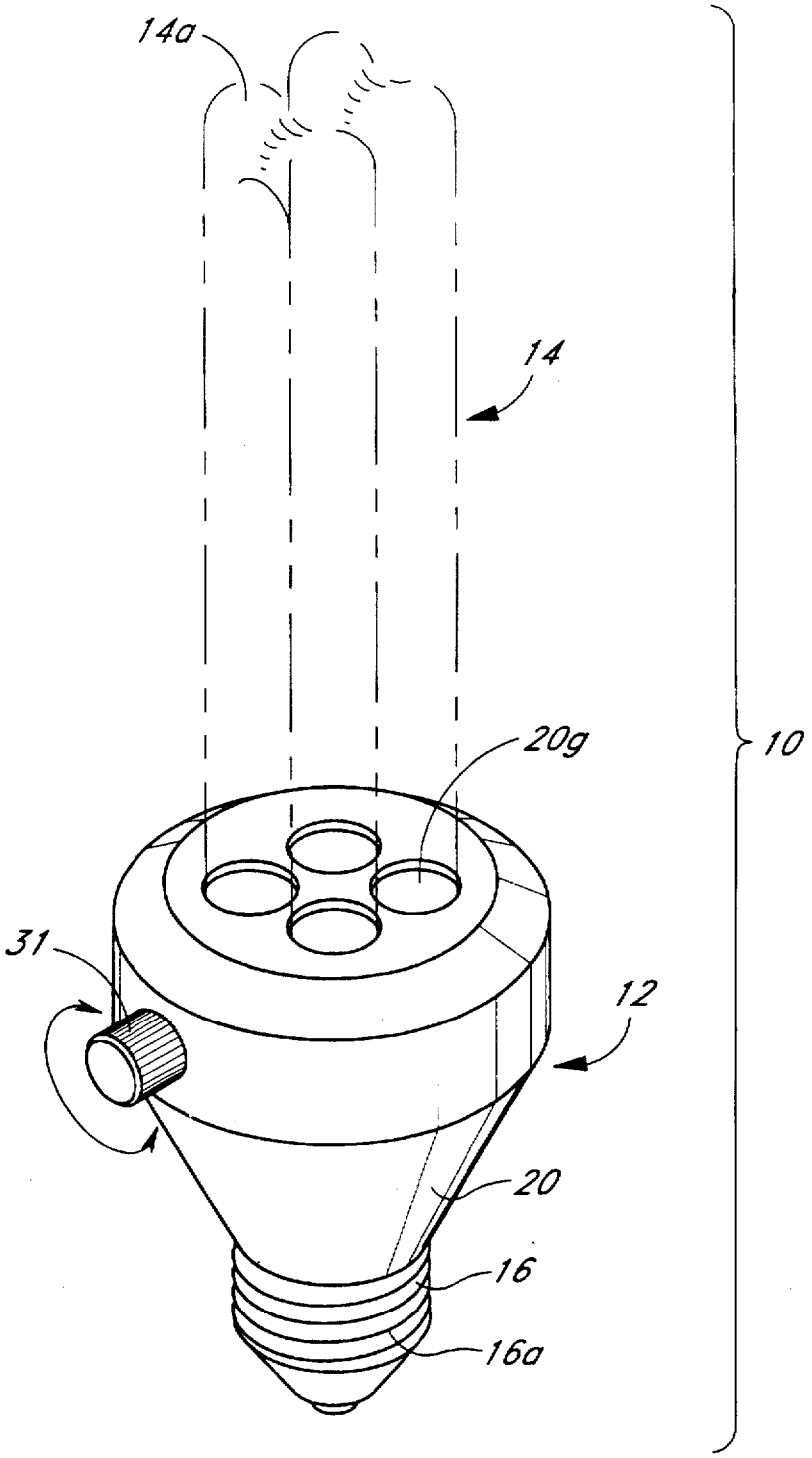
FIG. 1 is a perspective view of a dimmable compact screw-in fluorescent lamp apparatus constructed in accordance with this present invention.
Figure 2:
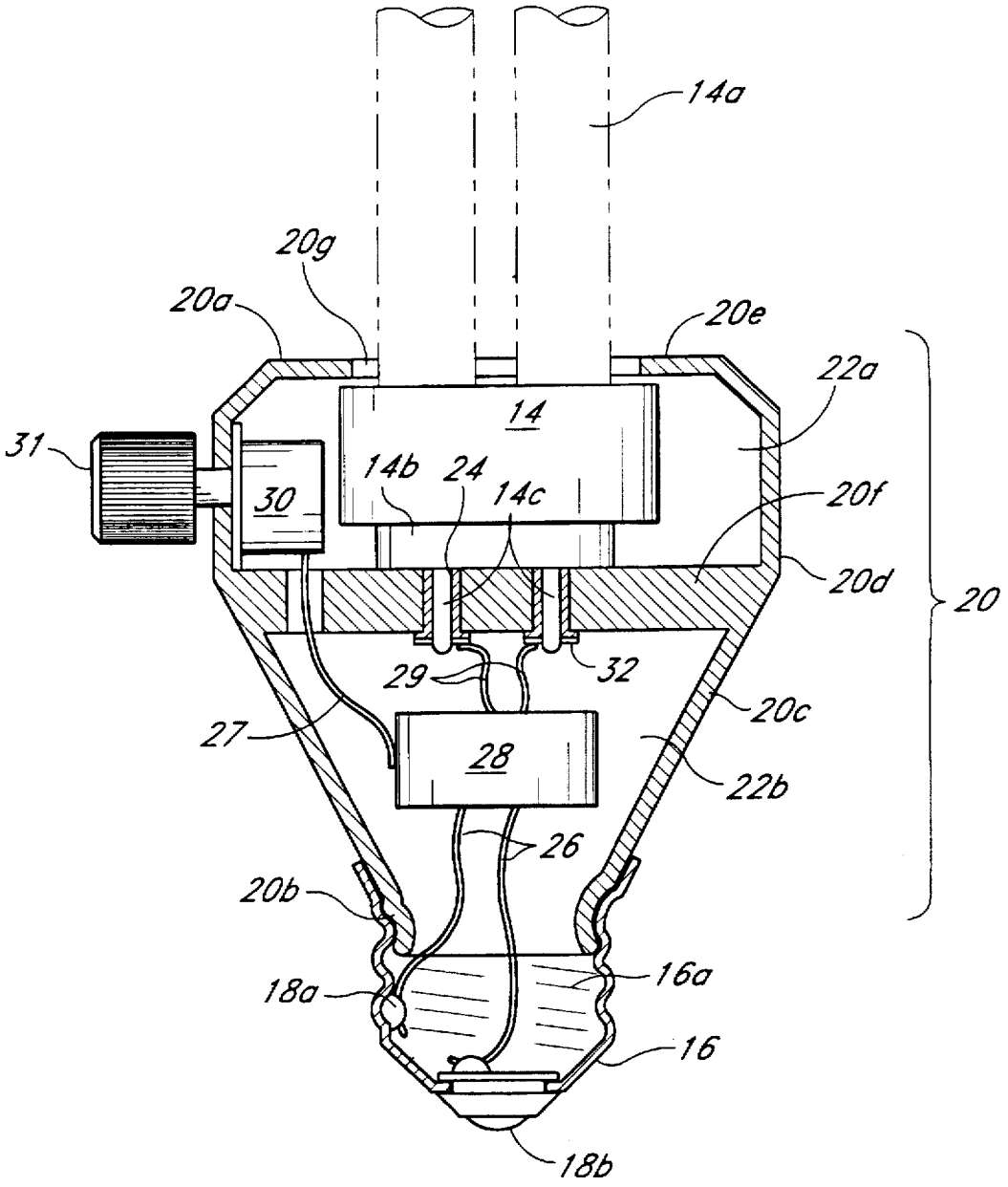
FIG. 2 is a side elevational view, partly in section, of a compact dimmable lamp apparatus according to the embodiment in FIG. 1.

As illustrated in FIGS. 1 and 2, a compact screw-in fluorescent lamp 10 includes a lamp base 12 which supports at one end a fluorescent lamp tube element 14. The fluorescent lamp element 14 comprises at least one fluorescent tube 14*a*, a base portion 14*b* and electrical contacts 14*c*. The opposite end of the lamp base 12 supports a conventional electrical screw-in socket 16 which includes threads 16*a* for threaded engagement with a conventional electrical lamp socket. This electrical socket 16 typically includes two electrical conductors 18*a* and 18*b* arranged for electrical connection with the corresponding conductors on the electrical lamp socket. As is conventional for fluorescent lamps, the electrical conductors 18*a* and 18*b* are located at the side and the bottom, respectively, of the socket 16.

The base 12 further includes an electrically insulative housing 20 having a top end 20*a* axially spaced from a bottom end 20*b*. The housing 20 has a generally overall conical or triangular shape which is narrow at the bottom end 20*b* and wider at the top end 20*a*. The housing 20 includes a funnel-like portion 20*c* above the bottom end 20*b* and below a cylindrical portion 20*d*. It will be understood that the housing 20 can have other cross-sectional configurations, such as for example, circular, ellipsoid, rectangular or triangular. The cylindrical portion 20*d* has a cylindrical wall and is bound at the top by a flat wall 20*e* and at the bottom by an interior panel 20*f* which spans the interior space 20 traverse to the longitudinal axis of the housing. The housing 20 thus bounds a hollow interior space 22 partitioned into an upper interior space 22*a* and a lower interior space 22*b* by the interior panel 20*f*. The base 16 is secured to the housing 20 at the bottom end 20*b* of the housing 20 to form the bottom of the adaptor 12.

The compact fluorescent lamp apparatus further includes the removable and replaceable fluorescent tube illumination element 14. In the embodiment shown, the fluorescent lamp tube element 14 removably and replaceably plugs into socket connectors 32 supported by the interior panel 20*f*. The base portion 14*b* of the fluorescent lamp tube element 14 seats on the top face of panel 20*f* and passes through openings 20*g* in the top wall 20*e* of the housing 20. The electrical contacts 14*c* extend through the openings 24 in the panel 20*f* to removably and replaceably plug into connective socket connectors 32 to thereby provide electrical connection between the illumination element 14 and the adaptor 12. In an alternative embodiment not shown, the fluorescent lamp tube element 14 is permanently affixed to the housing 2*d* so that the entire fixture of FIG. 1 is sold and installed as an integral unit.

A circuit housing 28 contains a ballast circuit 49 which will be described in more detail below in connection with FIG. 3. The circuit housing 28 is mounted within the housing 20 in the lower interior space 22*b*. Input electrical conductors 26 of the circuit housing 28 connect respectively to the electrical connector 18*a* and 18*b* of the socket base 16. Output conductors 29 from the ballast circuit housing 28 electrically connect to the electrical contacts 14*c* of the fluorescent illumination element 14 via the socket connections 32. The ballast circuit 49 applies an excitation current and voltage to the illumination element 14.

The lamp 10 further comprises an electrical adjustment element 30, such as a variable resistor, which has a manually adjustable knob 31. The adjustment element 30 electrically connects with the dimmable ballast circuit 49 via a conductor 27 and produces a controllable electrical signal in response to adjustment of the position of adjustment element 30. The adjustable knob 31 is preferably manually accessible on the exterior of the tubular portion 20*d* of the housing 20.

Figure 3:
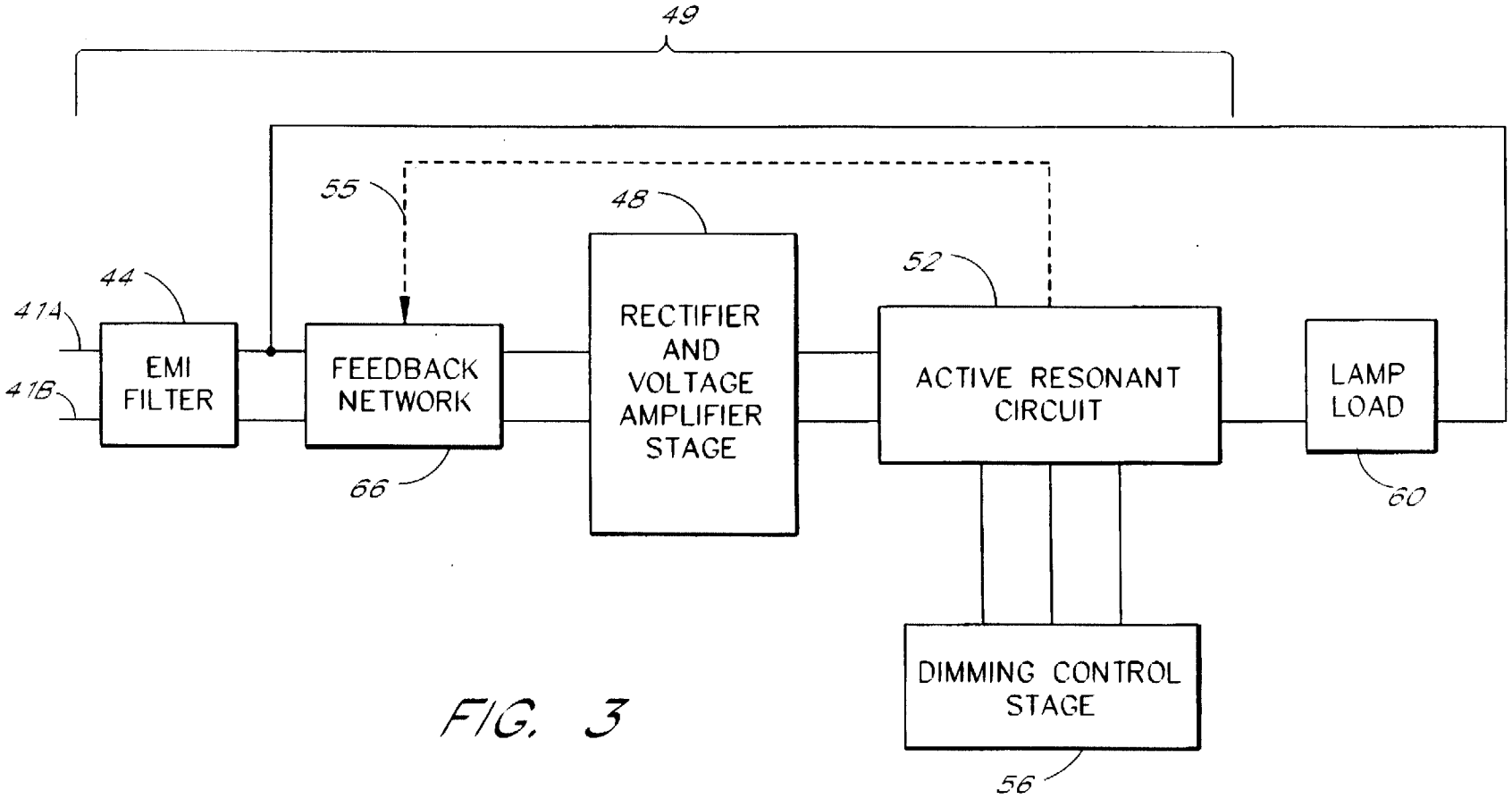
FIG. 3 is a block diagram of a ballast circuit constructed in accordance with this invention for use with the compact lamp apparatus of FIG. 1.

FIG. 3 is a block diagram of a dimmable ballast circuit 49 and a fluorescent lamp load 60 in accordance with one embodiment of the present invention. As discussed above, the circuit 49 is advantageously mounted in the lower interior lamp space 22*b* preferably within the ballast circuit housing 20 of FIG. 1. The ballast circuit 49 includes an EMI filter stage 44, a feedback network 66, a rectification and voltage amplification stage 48, and an active resonant circuit stage 52, which are connected to a lamp load 60, as shown. The lamp load 60 corresponds to the fluorescent tubes 14*a* in FIG. 1. The input AC source is connected to the high and low voltage lines 41*a* and 41*b*, respectively, which are in turn connected electrically in series with the EMI filter stage 44. The lines 41*a* and 41*b* correspond to the conductors 26 in FIG. 2. The outputs of the EMI filter stage 44 are connected to an input of the feedback network 66. Outputs of the feedback network are connected to inputs of the rectifier and voltage amplification stage 48. Outputs of the rectifier and voltage amplification stage 48 are connected to respective inputs of the resonant circuit stage 52. A power output of the resonant circuit stage 52 is connected in series with the lamp load 60. The lamp load 60 is connected between the output of the resonant circuit stage 52 and an input of the feedback network 66. Further, the resonant circuit stage 52 generates a high frequency feedback signal on a line 55 that is magnetically connected to the feedback network 66. The dimmable ballast circuit 49 also includes a dimmable control stage 56 which is connected in parallel to the active resonant circuit stage 52. The dimming stage 56 is electrically connected to the resonant circuit stage 52 and produces an output dimming signal for varying the current supplied to the lamp load 60 by the resonant circuit stage 52, as described in greater detail below.

The ballast circuit 49 has several significant features. The EMI filter stage substantially eliminates feedback of electromagnetic interference to the AC input line. The feedback network 66 and the magnetic feedback signal 55 substantially reduce the non-linearities of the load presented to the AC line. As described below with reference to FIG. 4, these and other features provide a practical compact fluorescent lamp which retains all of the advantages of the fluorescent lamp without the significant disadvantages of prior art ballast stages.

Figure 4:
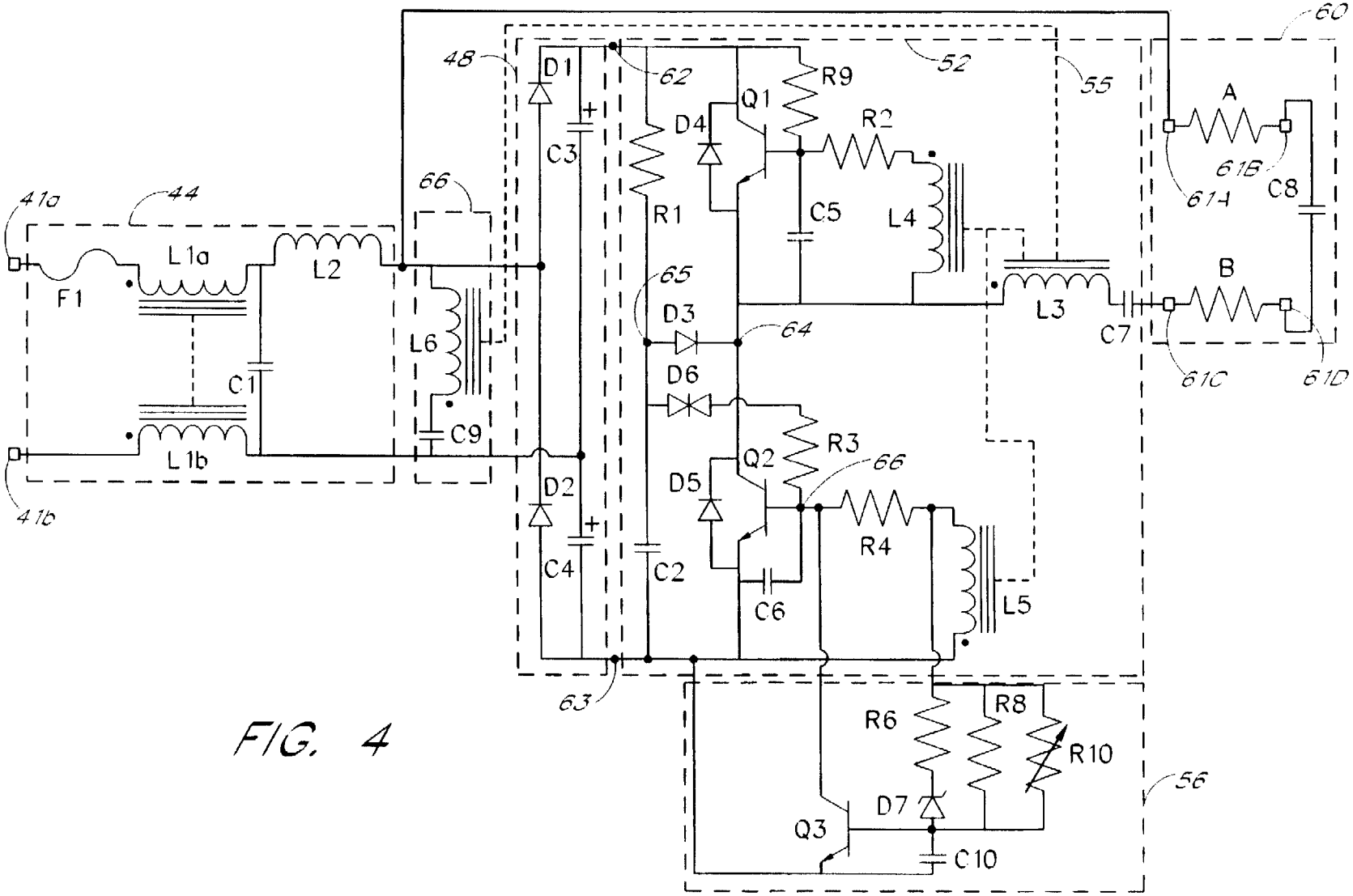
FIG. 4 is a schematic circuit diagram of the ballast circuit of FIG. 3.

FIG. 4 illustrates a detailed circuit schematic of the elements of the ballast circuit 49. The EMI filter stage 44 includes series inductors L1*a* and L1*b*, a fuse F1, a shunt capacitor C1 and a high frequency blocking inductor L2. The fuse F1 is connected electrically in series with the inductor L1*a*, which in turn is connected to one terminal of the shunt capacitor C1. A second terminal of the capacitor C1 is connected through the inductor L1*b* to the input line 41*b*, also referred to as the neutral rail. Advantageously, both the inductor L1*a* and the inductor L1*b* are magnetically coupled and are provided by two windings on a single core (not shown). The LC filter formed by the inductor L1*a*, the inductor L1*b* and the capacitor C1 ensures a smooth input waveform to the voltage amplification stage 48 by preventing interference with other electronic devices, as is known in the art. The coupled series inductor L2 prevents leakage of unwanted high frequency interference back into the power transmission lines. The fuse F1 protects the ballast circuit 49 and the lamp load 60 from damage due to over currents from the input power lines.

In a particularly preferred embodiment, the components of the EMI filter stage have the following values: the series inductors L1*a* and L1*b* are approximately 2.5 mH each; the fuse F1 is preferably a 1 Amp fuse; the shunt capacitor C1 is approximately 0.1 μF; and the high frequency blocking inductor L2 is approximately 1.2 mH.

The Feedback Network 66

The feedback network comprises a feedback capacitor C9 and a feedback inductor L6. The feedback inductor L6 has a dotted terminal and an undotted terminal. The undotted terminal of the feedback inductor L6 is connected to high frequency blocking inductor L2 and to a lamp terminal 61*c*. The dotted terminal of the inductor L6 is connected to a first terminal of the feedback capacitor C9. The second terminal of the feedback capacitor C9 is connected to a first terminal of the shunt capacitor C1. Magnetic feedback from the active high frequency resonant circuit stage 52 back to the feedback network 66 is provided by winding the feedback inductor L6 on the same core with the primary inductor L3 located in the stage 52. The primary inductor L3 has a dotted terminal which indicates the mutual inductance relationship with the feedback inductor L6. The feedback capacitor C9 carries considerable current and should be a low loss capacitor, preferably one with a power dissipation factor on the order of about 0.1% or less. In a specific embodiment, the components of the feedback network have the following values: the feedback capacitor C9 is a polypropylene capacitor having a value of approximately 0.0047 μF with a tolerance of about ±5%; the feedback inductor L6 comprises approximately 25 turns; and the primary inductor L3 comprises approximately 180 turns.

The Rectification and Voltage Amplification Stage 48

The stage 48 converts the input AC voltage to a DC voltage and amplifies the magnitude of this DC voltage to the level necessary to start or ignite the fluorescent lamp level and includes a pair of rectifying diodes D1 and D2, and capacitors C3 and C4. The anode of the diode D1 is connected to one terminal of the high frequency blocking inductor L2 and to the cathode of the diode D2. The cathode of the diode D1 is connected to one terminal of the resistor R1 and to the positive terminal of the capacitor C3. The opposite terminal of the capacitor C3 is connected to the neutral rail 41*b* through the inductor L1*b*. The anode of the diode D2 is connected to one terminal of the capacitor C4, the opposite terminal of which is connected to the neutral rail 41*b*. The diodes D1 and D2 selectively allow the capacitors C3, C4 to charge during portions of each cycle of the 60 cycle sinusoidal input voltage. For example, the diode D1 allows the capacitor C3 to charge at the peak voltage of the positive half cycle of the input voltage, and the diode D2 allows the capacitor C4 to charge at the peak voltage of the negative half cycle. As described below, during this start-up phase, the sum of the voltages across the capacitor C3 and the capacitor C4 is supplied in a series circuit to the fluorescent lamp load. The voltage amplification performed by the illustrated amplification stage is 2:1 and the output voltage is sufficient to start the fluorescent lamp.

In a specific embodiment, the components of the rectification and voltage amplification stage 48 have the following values: the rectifying diodes D1 and D2 are preferably UF4005 diodes; and the capacitors C3 and C4 are approximately 33 μF.

The Active High Frequency Resonant Stage 52

The stage 52 comprises a diode D3, a pair of switching transistors Q1 and Q2, each having a collector, an emitter and a base, free wheeling diodes D4 and D5, and a pair of capacitors C5 and C6. The free wheeling diode D4 is connected between the collector and emitter of the transistor Q1. The free wheeling diode D5 is connected between the collector and emitter of switching transistor Q2. The resonant stage 52 further comprises transistor driving resistors R2 and R4, a primary inductor L3, which is associated with the secondary inductors L4 and L5, and a DC blocking capacitor C7. The inductors L3, L4, L5 and L6 are advantageously provided by an E core on which is wound the primary winding for the inductor L3 and the secondary windings for the inductors L4, L5, and L6. Thus, the inductor L3 is magnetically coupled to the inductors L4, L5 and L6. The inductors L4 and L5 are oppositely poled and thus are driven out of phase relative to each other. More specifically, the inductor L4 generates the driving voltage for the transistor Q1 during the positive half cycle of the input voltage, and the inductor L5 generates the driving voltage for the transistor Q2 during the negative half cycle. The free wheeling diode D4 provides a current path for the dissipation of magnetic energy stored in the coupled inductor L4 when the transistor Q1 switches off. The free wheeling diode D5 provides a current path for the dissipation of magnetic energy stored in the coupled inductor L5 when the transistor Q2 switches off. The resonant stage 52 is further connected electrically in series with the lamp load 60. The lamp load 60 includes the output connections 61*a*, 61*b*, 61*c* and 61*d*, and a lamp striking capacitor C8. The striking capacitor C8 is also referred to as a "resonating capacitor". Preferably, a lamp filament element A is connected between the connections 61*a* and 61*b*, and a lamp filament element B is connected between the connections 61*c* and 61*d*.

The collector of the transistor Q1 is electrically connected to a circuit junction 62, and the emitter of the transistor Q1 is connected to a circuit junction 64. The capacitor C5 is electrically connected between the base and the emitter of the transistor Q1. The driving resistor R2 is connected at one terminal to the dotted terminal of the inductor L4 and at another terminal to the base of the transistor Q1. The anode of the diode D3 is connected to a circuit junction 65. The cathode of the diode D3 is connected to the circuit junction 64. One terminal of the capacitor C7 is connected to the output connection 61*a* of the lamp load 60. The resonating capacitor C8 is electrically connected between the circuit connections 61*b* and 61*d*.

The collector of the transistor Q2 is electrically connected to the circuit junction 64, and the emitter of the transistor Q2 is electrically connected to a circuit junction 63. The capacitor C6 is connected between the base and the emitter of the transistor Q2. The base of the transistor Q2 is electrically connected to one terminal of the driving resistor R4. The inductor L5 has two terminals, one of which is dotted to show the polarity mutual inductance relationship with the dotted terminal of the inductor L3. The second terminal of the resistor R4 is connected to the undotted terminal of the inductor L5. The dotted terminal of the inductor L5 is connected to the circuit junction 63. A bias resistor R9 is connected between the base and emitter of the transistor Q1.

In a specific embodiment, the components of the resonating stage 52 have the following values: the transistors Q1 and Q2 are BUL45 transistors; the diode D3 is a UF4005 diode; the free wheeling diodes D4 and D5 are UF4005 diodes; the capacitors C5 and C6 are approximately 0.1 μF; the transistor driving resistor R2 is approximately 56 Ω and is rated at 2 watts; the transistor driving resistor R4 is approximately 56 Ω and is rated at 2 watts; the bias resistor R9 is approximately 470 kΩ and is rated at ¼ watt; the primary inductor L3 is a 2.0 mH inductor having 180 turns which is associated with the secondary inductor L4 having 4 turns and the secondary inductor L5 having 4 turns; and the DC blocking capacitor C7 is 0.1 μF.

The capacitor C2, the diac D6 and the current limiting resistors R1 and R3 form a starter circuit that initially, at the application of power to the ballast circuit 49, actuates or turns ON the transistor Q2 in the active resonant stage 52. One terminal of the current limiting resistor R1 is connected to a junction 62. The opposite terminal of the current limiting resistor R1 is connected to the capacitor C2, to the diac D6 and to an anode of a current blocking diode D3 at the circuit junction 65. An opposite terminal of the capacitor C2 is connected to the anode of the diode D2, to the diac D6, and to the current limiting resistor R3. The opposite terminal of the current limiting resistor R3 is connected to the base of the transistor Q2.

In a specific embodiment, the components of the starter circuit have the following values: the capacitor C2 is approximately 0.1 μF; the diac D6 is an approximately 32-volt diac; the current limiting resistor R3 is approximately 330 Ω and is rated at ¼ watt; and the current limiting resistor R1 is approximately 470 Ω and is rated at ¼ watt.

The Dimming Stage 56

The dimming feature is provided by the dimming stage 56. The dimming stage 56 includes a transistor Q3, a capacitor C10, resistors R6 and R8, a variable resistor R10, and a zener diode D7. The collector of the transistor Q3 is electrically connected to a circuit junction 68. The emitter of the transistor Q3 is electrically connected to the dotted terminal of the inductor L5, to one terminal of the capacitor C6, and to one terminal of the capacitor C10. The opposite terminal of the capacitor C10 is connected to the base of the transistor Q3 and to one terminal of the resistor R8. The opposite terminal of the resistor R8 is connected to the undotted terminal of the inductor L5. The variable resistor R10 is connected in parallel with the resistor R8. The zener diode D7 is connected in series with the resistor R6. The series combination of the diode D7 and the resistor R6 is connected in parallel with the variable resistor R10.

In a specific embodiment, the components of the dimming stage 56 have the following values: the transistor Q3 is a 2N3904 transistor; the capacitor C10 is approximately 0.01 μF; the resistor R6 is approximately 620KΩ and is rated at ¼ watt; the variable resistor R10 is approximately 2KΩ and is rated at ¼ watt; the zener diode D7 is an 8.2 volt zener diode; and the resistor R8 is approximately 1.37KΩ and is rated at ¼ watt.

Active Resonant Stage Startup Mode of Operation

During the start mode of the active resonant stage 52, the switching transistor Q2 is actuated by the starter circuit. Specifically, when the capacitor C2 charges to a voltage greater than the reverse breakdown voltage of the diac D6, the diac D6 discharges the capacitor C2 through the current limiting resistor R3, turning ON the transistor Q2. Once the transistor Q2 is turned on, the switching transistors Q1 and Q2 alternately conduct during each half cycle of the output voltage and are driven during normal circuit operation by energy stored in the inductor L3 and transferred to the secondary windings of the inductors L4 and L5. Therefore, the starter circuit only operates during initial start mode and is not required during the normal operation of the resonant stage 52.

Resonant Mode of Operation

As further illustrated in FIG. 4, during normal or resonant operation, the ballast circuit 49 is energized by the application of the sinusoidal input voltage having a selected magnitude and frequency to the input power lines 41*a* and 41*b*. In the typical embodiment, the input power has a magnitude of 120 volts and a frequency of 60 hertz. The input voltage is filtered by the EMI filter stage 44, as described above, and produces an input current flow through the feedback network and into the voltage and rectification circuit 48. During each positive half cycle, current flows through the series combination of the diode D1, the transistor Q1, the inductors L3 and L6, and the capacitors C7, C8 and C9. During each negative half cycle, current flows through the diode D2, the capacitor C2, the transistor Q2 and the inductors L3 and L6, and the capacitors C7, C8 and C9. During normal operation, the capacitor C2 discharges through the diode D3 after each negative cycle of the input voltage. Concomitantly, each capacitor C3 and C4 charges during the peak portion of each corresponding half cycle, and discharges during the other half cycle. For example, the capacitor C3 charges during the positive half cycle of the input line voltage, and discharges through the neutral rail 41*b* during the negative half cycle, while the capacitor C4 charges during the negative half cycle of the input line voltage, and discharges through the neutral rail 41*b* during the positive half cycle.

The inductors L3 and L6 store energy along with the capacitors C7, C8 and C9, and form a series resonant circuit. These components produce a current having a selected elevated frequency, preferably greater than 20 kilohertz, and most preferably around 49 kilohertz, during normal operation of the ballast circuit. This high-frequency operation reduces hum and other electrical noises delivered to the lamp load. Additionally, high-frequency operation of the lamp load reduces the occurrence of annoying flickering of the lamp.

The resonating capacitor C8 stores a selected elevated voltage, preferably equal to or greater than 300 volts rms, which is required to start or ignite the fluorescent lamps mounted at the lamp connection 61*a* to 61*d*. Once the lamps are struck, the circuit operating voltage is reduced to a value slightly greater than the input voltage, preferably around 100 volts rms, which is maintained by the feedback network 66.

Improved Power Factor

A significant feature of this invention is that the power factor of the ballast is substantially improved over the prior art. A typical series resonant circuit provides for a poor power factor because the input appears very distorted and non-linear due to the effects of the capacitors and the rectification diodes. In a typical series resonant circuit, the rectification diodes are only turned ON during the periods of the peak voltages of the positive and negative cycles of the input AC voltage. Generally, the charging capacitor C3 charges up to its peak voltage during the positive input cycle and then dissipates during the negative input cycle causing the diode D1 to only turn ON during the peak dissipation period of the capacitor C3, i.e., the negative portion of the input cycle. Generally, the charging capacitor C4 charges up to its peak voltage during the negative input cycle and then dissipates during the positive input cycle causing the diode D2 to only turn ON during the peak dissipation period of the capacitor C4, i.e., the positive portion of the input cycle. This results in an input of varying current spikes at these peak periods which is not desired.

In the present invention, the feedback network 66, consisting of the series combination of the capacitor C9 and the inductor L6, feeds back a selected high frequency voltage level across the inputs of the voltage amplification stage 48. The feedback network 66 divides a high frequency feedback current from the lamp load between the neutral rail and the input of the rectification circuit. In addition, the capacitor C9 operates as a DC blocking capacitor for preventing the passage of unwanted DC current to the neutral rail 41B. This high frequency feedback current supplied by the feedback network, when applied to the diodes at the input of the rectification circuit 48 expands the conduction angle of the diodes D1 and D2. The expansion of the conduction angle of the diodes D1 and D2 essentially forces the rectification diodes D1 and D2 to conduct during substantially the entire portion of their respective positive and negative half cycles. Therefore, the high frequency feedback current substantially eliminates the non-linear characteristic of the diodes, by causing them to conduct even during the low frequency current periods of each of the positive and negative half cycles. By eliminating the non-linearities of the diodes, the ballast circuit appears as an almost linear load at the input voltage interface, i.e., a power factor of 0.95 or greater, thus achieving a very high level of power factor correction to the series resonant circuit.

The effective impedance of the feedback network 66 determines the amount of the high frequency current that is fed back to the rectification circuit and the amount that is dissipated through the neutral rail. The smaller the effective impedance the lesser the amount of current that is fed back to the rectification circuit and vice versa. The effective impedance of the feedback network is determined by the impedance of the feedback capacitor C9 and the effective impedance of the feedback inductor L6. The effective impedance of the feedback inductor L6 is a function of both the inductance and the amount of magnetic feedback generated by feedback path 55. The magnetic feedback into the feedback inductor L6 is generated by the lamp load current flowing through L3. Thus, as the lamp current increases, the magnetic feedback signal increases and the voltage drop across the feedback inductor will increase. To achieve the desired amount of power factor correction at the input of the rectification circuit, the voltage drop across the network 66 should preferably be maintained in the range of or greater than the input voltage, i.e., approximately 100 volts rms.

The ballast circuit 49 of the present invention achieves a power factor in the range of 0.95 by employing the feedback topology of the present invention which is a significant improvement over the power factor of 0.4 which was common in prior art ballast circuits. The feedback network 66 also significantly reduces the total harmonic distortion of the lamp by dampening amplified higher order frequency harmonics present in the ballast circuit from the uncorrected input voltage.

Dimmer Circuit Mode of Operation

The illustrated dimming stage 56 adjusts the level of lamp illumination by turning OFF the transistor Q2 for selected portions of the voltage half cycle in which the transistor Q2 would normally be turned ON, i.e., conducting. In a preferred embodiment, the conduction state of the transistor Q3 controls the conduction state of the transistor Q2. Specifically, when the transistor Q3 conducts, the transistor Q2 turns OFF and, conversely, when the transistor Q3 is turned OFF, the transistor Q2 conducts.

The variable resistor R10 controls the conduction state of the transistor Q3 by varying the voltage drop across the capacitor C10. According to one embodiment, when the dimming stage total dimming resistance, defined as the parallel combination of the resistor R8 and the variable resistor R10, is relatively high, referred to as a minimum dimming condition, the voltage drop across the capacitor C10 is insufficient to turn ON transistor Q3. During these conditions, the transistor Q2 continues to conduct uninterruptedly during its normal conduction portion of the resonant circuit, and maximum current is supplied to the lamp load 60 to produce maximum lamp illumination. When the total dimming resistance is relatively low, the voltage drop across the capacitor C10 increases and turns ON the transistor Q3, which then prematurely turns OFF the transistor Q2 during some selected portion of the resonant circuit cycle. When the transistor Q2 turns off, the resonant circuit automatically switches to the transistor Q1 conduction portion of the resonant circuit. The total dimming resistance can be varied by manually adjusting the variable resistor R10 to define a lower or higher resistance for minimum dimming or maximum dimming, respectively. Specifically, the total dimming resistance, as defined by the variable resistor R10 and the resistor R8, determines the specific portion of the resonant circuit cycle in which transistor Q2 conducts. This, in turn, determines the amount of the lamp driving current that is applied to the load, and thus determines the lamp illumination level.

A delay circuit is connected to the base of the transistor Q3. This delay circuit comprises a zener diode D7 in series with a resistor R6. The zener diode D7 ensures proper start-up operation of the fluorescent lamp by forcing the ballast circuit 49 to initially operate in maximum dimming conditions, e.g., minimum total dimming resistance. This condition exposes the fluorescent lamp filaments to an appropriately high voltage level. During start-up operations, the voltage amplification forces the zener diode D7 to operate in its reverse breakdown region, thus temporarily by-passing the resistors R8 and R10 and maintaining a voltage drop across the capacitor C10 sufficient to cause the transistor Q3 to remain on and the transistor Q2 to remain off. Consequently, the dimming circuit 56 operates during start-up for maximum dimming, regardless of the position of the variable resistor R10. This topology allows the ballast circuit to accumulate high voltage levels across the lamp filaments and at the resonating capacitor C8 for subsequent striking of the lamp. Once the lamp is struck and the ballast circuit operates at the substantially reduced circuit running voltage, the zener diode D7 stops conducting, and the variable resistor R10 is again electrically associated with the dimming circuit.

Advantages of the Ballast Circuit of FIG. 4

The ballast circuits of the prior art, both dimmable and non-dimmable, required a larger number of components than the dimmable ballast circuit of the present invention. The large number of components in the prior art ballast circuits resulted in a low power efficiency of the circuit. Further, the additional components lowered the overall reliability of the circuit. Finally, the larger number of components caused difficulties in the manufacturing of the circuit.

A significant feature of the ballast circuit of the present invention is that it requires only one single active stage to perform all the necessary functions of a ballast circuit, including lamp start-up, lamp driving operations, and local dimming of the lamp. The streamlined circuit design of FIG. 4 also provides for high electrical efficiency of the operating circuit because of the lack of additional parasitic active stages. In addition, as discussed above, the illustrated resonant circuit provides for low total harmonic distortion and for high power factor correction, for example, achieving a power factor of 0.95 or greater.

By only requiring one active stage, the ballast circuit of the present invention emits less electromagnetic interference (EMI) and radio-frequency interference (RFI) than prior art fluorescent lamp ballast circuits. The prior art ballast circuits had at least two active stages which operated at different frequencies. The noise caused by the independent active stages operating at different frequencies combine to form a high level of noise which has several different components which are hard to separate and filter out. The ballast circuit of the present invention has only one active stage and therefore operates at only one frequency at a time and at a significantly lower noise level than the multiple active stage ballast circuits of the prior art. By only having a ballast circuit with only one active stage, the EMI filter stage 44 is able to filter the electromagnetic interference (EMI) to an acceptable level. Further, by having only one fundamental frequency of noise produced by the single active stage of the ballast circuit, the radio-frequency interference (RFI) can be kept at a lower, more acceptable, level.

The lower component count of the compact ballast circuit of the present invention reduces the reliability and manufacturing problems common in prior art dimmable ballast circuits. In addition, by lowering the active component count, the power dissipation across the dimmable ballast circuit of the present invention is significantly lower than in ballast circuits of the prior art. The lowered power dissipation of the dimmable ballast circuit causes a lower ambient temperature in the ballast circuit housing 20. The lower ambient temperature reduces the long term stress on the components of the ballast circuit and increases the overall reliability of the circuit.

Many prior art ballast dimmer circuits can suffer catastrophic failure if power is applied without a fluorescent lamp in its socket. This adverse phenomena cannot occur with the invention since, with the lamp removed, the circuit of FIG. 4 is essentially an open circuit and the active resonant stage cannot initiate resonant high-frequency operation.

The illustrated dimmable circuit of FIG. 4 can further be modified for use with a non-dimmable fluorescent lamp by replacing the variable resistor R10 with a fixed resistor (not shown). The value of the fixed resistor preferably continually biases this transistor Q3 off, allowing the application of maximum power to the fluorescent lamp. Alternatively, the entire dimming stage 56 can be removed from the circuit as discussed in association with FIG. 4, to reduce the overall cost of manufacturing the ballast circuit.

Further Advantages of the Circuit of FIG. 4

Typically, series resonant circuits tend to amplify higher order harmonics, since the series resonant capacitor resonates with the inductance of the power line inductor creating a ringing affect that amplifies these higher order harmonics. The high frequency voltage supplied by the feedback network 66 modulates the amplitude of the low frequency input voltage. The modulation of the amplitude of the low frequency input voltage functions as a carrier to transport the high frequency current over substantially the entire low frequency cycle, e.g., 60 hertz. Therefore, connecting the feedback network 66 to the input of the voltage amplification stage 48 also significantly reduces the total harmonic distortion. The feedback network 66 insures a relatively clean, e.g., correct, sinusoidal input voltage waveform suitable for operating one or more fluorescent lamps. Correcting distortions of the input voltage waveform protects the lamp from damage by transient signal perturbations as well as control current distortions that arise from the non-corrected input voltage.

Avoidance of Striation and Flickering Problems

The dimmable ballast circuits of the prior art suffered from striation problems and flickering problems, because the dimmable ballast circuits were not capable of properly driving the lamp load during certain dimming conditions, i.e, insufficient power was being supplied to the filaments. The impedance of the lamps, as measured by the voltage across the lamps divided by the current through the lamps, increases during dimming conditions. The dimmable ballast circuit 49 of the present invention dims the lamp by reducing the current delivered to the lamps; however, at the same time the voltage delivered to the lamps by the resonating capacitor C8 is increased. Therefore, the power to the filaments is maintained at a proper driving level. During full power, the filament voltage is approximately 2.2 volts. During a 20% dimming condition, the filament voltage increases to approximately 4.0 volts.

Further, by maintaining the power delivered to the filament at a preferred driving power range, the dimmable ballast circuit 49 of the present invention is capable of properly driving the lamp filament over a wider dimming range without having the flickering and striation problems associated with prior art dimmable fluorescent lamps.

Remote Dimmer Control

Although the specific embodiments described above have been described with reference to the dimmable control ballast being located as an integral unit with the fluorescent lamp, the present invention can also be advantageously used as a remote dimmer control, e.g., used in a wall-mounted control unit. A particular advantage of the circuit of FIGS. 3 and 4 is that, as shown, only two wires are needed to connect the remotely mounted ballast stage 49 and the fluorescent lamp 60.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A ballast for a dimmable, screw-in compact fluorescent lamp, said ballast comprising:

an EMI filter stage connecting to line voltage;

a feedback network having an input connected to the output of said EMI filter stage a rectification and voltage doubler stage having an input connected to the output of said feedback network;

a dimmer control;

a single active stage comprising a high frequency resonant circuit, said resonant circuit connected to said dimmer control and to the output of said rectification and voltage doubler stage, said active stage producing an output having a first cycle portion and a second cycle portion, said active stage varying a duration of said second cycle portion in response to said dimmer control; and a magnetic feedback path which couples said high frequency resonant circuit to said feedback network.

2. A ballast for a fluorescent lamp providing a power factor to an input voltage line of 95% or higher, said ballast comprising:

a rectification stage energized by said input voltage line, said rectification stage comprising diodes which rectify the input line voltage, said diodes being driven substantially continuously in the conducting state including those periods when the input line voltage is below the threshold level of the diode;

a high frequency resonant circuit having an input connection to the output of said rectification stage, an output coupled to said diodes, and a primary inductor; and a feedback network, said feedback network electrically connected in shunt across said input line voltage, said feedback network magnetically coupled to said high frequency resonant circuit.

3. The ballast according to claim 2, wherein said feedback network comprises:

a feedback inductor, said feedback inductor magnetically coupled to an inductive element in said high frequency resonant circuit; and a feedback capacitor, said feedback capacitor electrically connected in series with said feedback inductor.

4. A compact fluorescent lamp ballast apparatus comprising:

an EMI filter stage connecting to line voltage;

a feedback network having an input connected to the output of said EMI filter stage;

a rectification and voltage doubler stage having an input connected to the output of said feedback network, said rectification stage comprising diodes rectifying the input line voltage; and an active, high frequency resonant circuit connected to the output of said rectification and voltage doubler stage, said high frequency resonant circuit magnetically coupled to said feedback network.

5. The compact fluorescent lamp ballast apparatus according to claim 3, wherein said ballast further comprises a dimmer circuit connected to said high frequency resonant circuit.

6. A fluorescent lamp apparatus for connecting with at least one fluorescent lamp and with an input power source supplying an AC input voltage, said fluorescent lamp apparatus comprising:

a rectification and voltage doubler stage, an input of said rectification and voltage doubler stage connected to said input power source;

an active resonant stage, an input of said active resonant stage connected to an output of said rectification and voltage doubler stage and an output of said active resonant stage connected to said at least one fluorescent lamp, said active resonant stage further comprising:

first and second switching transistors, each of said transistors having a base, an emitter and a collector; and a primary inductor associated with first and second secondary inductors, a first terminal of said primary inductor connected to the emitter of said first transistor and a second terminal of said primary inductor connected to a first terminal of said at least one fluorescent lamp, said first secondary inductor connected between the base and the emitter of said first switching transistor and said second secondary inductor connected between the base and emitter of said secondary switching transistor; and a feedback network comprising an inductor magnetically coupled to said primary inductor.

7. The fluorescent lamp apparatus of claim 6, further comprising a dimmer control circuit to control the operation of the second switching transistor to suppress the operation of said second switching transistor during a portion of the conductive cycle of the second switching transistor to provide a dimmed output of the fluorescent lamp, said dimmer control circuit connected to said active resonant circuit to thereby vary a duration of said conductive cycle.

8. The fluorescent lamp apparatus of claim 6, wherein said feedback network is connected in shunt across the terminals of said input power source.

9. The fluorescent lamp apparatus of claim 6 further comprising an EMI filter stage connected between said input power source and said rectification and voltage doubler stage.

10. The fluorescent lamp apparatus of claim 8, said feedback network further comprising a feedback capacitor in series with said feedback inductor.

11. A compact fluorescent lamp apparatus for connection with at least one fluorescent lamp and with an input power source supplying an AC input voltage, said fluorescent lamp apparatus comprising:

a feedback network, said feedback network electrically connected to said input power source;

a rectifier which rectifies said AC input voltage, said rectifier connected to the output of said feedback network;

a resonant circuit electrically connected to said lamp, said resonant circuit generating a high frequency voltage in response to said input voltage, and further varying the level of power supplied to the lamp in response to said dimming signal, thereby attaining a selected level of lamp brightness; and a magnetic feedback circuit, said magnetic feedback circuit magnetically coupling said resonant circuit and said feedback network.

12. The compact fluorescent lamp apparatus according to claim 11, wherein said rectifier further comprises a voltage doubler for doubling said input voltage.

13. The compact fluorescent lamp apparatus according to claim 12, wherein said rectifier includes at least first and second diodes and at least first and second capacitors in circuit with said diodes.

14. The compact fluorescent lamp apparatus according to claim 11, wherein said resonant circuit is a series resonant circuit.

15. The compact dimmable fluorescent lamp apparatus according to claim 11, wherein said resonant circuit further comprises:

a DC filter which filters DC voltage components from said high frequency voltage; and a lamp striking circuit which selectively actuates said fluorescent lamp.

16. The compact fluorescent lamp apparatus according to claim 15, wherein said DC filter includes a capacitive element, and wherein said lamp striking circuit is connected electrically in parallel with the lamp and includes an inductor and a capacitor.

17. The compact fluorescent lamp apparatus according to claim 11, wherein said ballast circuit further includes at least first and second semiconductor switching elements for alternatively conducting selected portions of said AC input voltage during operation of the lamp.

18. The compact fluorescent lamp apparatus according to claim 11, wherein said ballast circuit further includes means for dimming.

19. The compact fluorescent lamp apparatus according to claim 18, wherein said means for dimming includes a third transistor, a capacitive element, and a manually variable resistance element, said manually variable resistance element connected to said capacitive element, said capacitive element being connected to a controlling input of said third transistor, said third transistor in turn being connected to an input of said second semiconductor switching element such that said manually variable resistance element controls a switching time of said second semiconductor element to selectively determine an illumination brightness level of said lamp.

20. The compact fluorescent lamp apparatus according to claim 19, wherein a charge on said capacitive element is responsive to said manually variable resistance element, said charge applied to said third transistor to control conduction of said third transistor.

21. The compact dimmable fluorescent lamp apparatus according to claim 19, wherein each of said first and second switching elements has a normal conduction interval, and wherein said charge applied to said third transistor controls said third transistor to thereby terminate said normal conduction of one of said first and second transistors prior to said normal conduction interval.

22. The compact fluorescent lamp apparatus according to claim 19, wherein said means for dimming further comprises a by-pass circuit connected to said controlling input of said third transistor, said by-pass circuit allowing a current to electrically by-pass said variable resistor during start-up operation of said lamp.

23. The compact fluorescent lamp apparatus according to claim 22, wherein said by-pass circuit comprises a zener diode connected to said controlling input of said third transistor.

24. The compact fluorescent lamp apparatus according to claim 11, further comprising an EMI filter to filter high frequency noise components generated by said resonant circuit to prevent leakage of said noise into said input power source, and to filter electromagnetic interference from said input power source, said EMI filter connected between said input power source and said feedback network.

25. The compact fluorescent lamp apparatus according to claim 11, wherein said magnetic feedback comprises a primary inductive element in series with said fluorescent lamp, said primary inductive element magnetically coupled to an inductive element in said feedback network.

26. The compact fluorescent lamp apparatus according to claim 13, wherein said feedback network further includes a conduction angle expansion circuit for expanding the conduction angle of said diodes.

27. The compact fluorescent lamp apparatus according to claim 11, wherein said feedback network further comprises a power factor correction circuit to correct said power factor of said input voltage.

* * * * *

UNITED STATES PATENT AND TRADEMARK OFFICE

CERTIFICATE OF CORRECTION

PATENT NO. : 5,798,617

DATED : August 25, 1998

INVENTOR(S) : Mihail S. Moisin

It is certified that error appears in the above-identified patent and that said Letters Patent is hereby corrected as shown below:

In Column 8, line 41, please replace "470Ω" with --470 KΩ--.

Signed and Sealed this

First Day of June, 1999

*Attest:*

Q. TODD DICKINSON

*Attesting Officer*

*Acting Commissioner of Patents and Trademarks*